US009060628B2

(12) United States Patent
Evans

(10) Patent No.: US 9,060,628 B2
(45) Date of Patent: Jun. 23, 2015

(54) PARTY PLATE

(71) Applicant: Gregory A. Evans, Olympia Fields, IL (US)

(72) Inventor: Gregory A. Evans, Olympia Fields, IL (US)

( * ) Notice: Subject to any disclaimer, the term of this patent is extended or adjusted under 35 U.S.C. 154(b) by 0 days.

(21) Appl. No.: 13/776,897

(22) Filed: Feb. 26, 2013

(65) Prior Publication Data

US 2014/0239000 A1 Aug. 28, 2014

(51) Int. Cl.
*A47G 19/06* (2006.01)
*A47G 19/02* (2006.01)

(52) U.S. Cl.
CPC ..... *A47G 19/065* (2013.01)

(58) Field of Classification Search
CPC ..... A47G 19/03; A47G 19/065; A47G 19/06; A47G 19/02
USPC ..... 220/574, 574.1, 23.83, 737, 738; 206/541, 223, 562, 563, 564, 565
See application file for complete search history.

(56) References Cited

U.S. PATENT DOCUMENTS 3,115,251 A * 12/1963 Farrell ..... 211/41.2
4,938,373 A * 7/1990 McKee ..... 220/23.86
5,060,820 A * 10/1991 Boerner ..... 220/574
5,119,967 A * 6/1992 Ercolani ..... 220/23.6
5,249,700 A * 10/1993 Dumke ..... 220/574
5,346,010 A * 9/1994 Adams et al. ..... 166/279
5,346,070 A 9/1994 McSpadden
5,593,062 A * 1/1997 Martin ..... 220/574.1
5,727,678 A * 3/1998 Chen ..... 206/217
6,264,023 B1 * 7/2001 Dutto et al. ..... 198/739
6,264,026 B1 * 7/2001 Bradley ..... 206/217
6,702,141 B1 * 3/2004 Cinque ..... 220/575
6,824,002 B1 * 11/2004 Hadland ..... 220/23.83
2004/0262482 A1 * 12/2004 Lim ..... 248/311.2
2005/0151034 A1 * 7/2005 Shendelman ..... 248/121
2007/0062939 A1 * 3/2007 Davis et al. ..... 220/23.2
2008/0142528 A1 * 6/2008 Lim ..... 220/575

* cited by examiner

*Primary Examiner* — Robert J Hicks

(57) ABSTRACT

A party plate composite for use at social gatherings and the like that serves as a plate for food as well as a holder for an eating utensil, a napkin, and a beverage container, to enable the user to hold all with one hand while leaving the other hand free to shake hands with others, or use a cell phone, to use the eating utensil or napkin, or to drink the beverage, the party plate composite comprising (a) a plate component for depositing food upon the upper surface thereof, and having an aperture depending through the upper and lower surfaces of the plate component, (b) a coupler component for disposition into the aperture and for attachment within the aperture, and (c) a beverage container holder component appropriately attached to the lower portion of the coupler component.

15 Claims, 4 Drawing Sheets

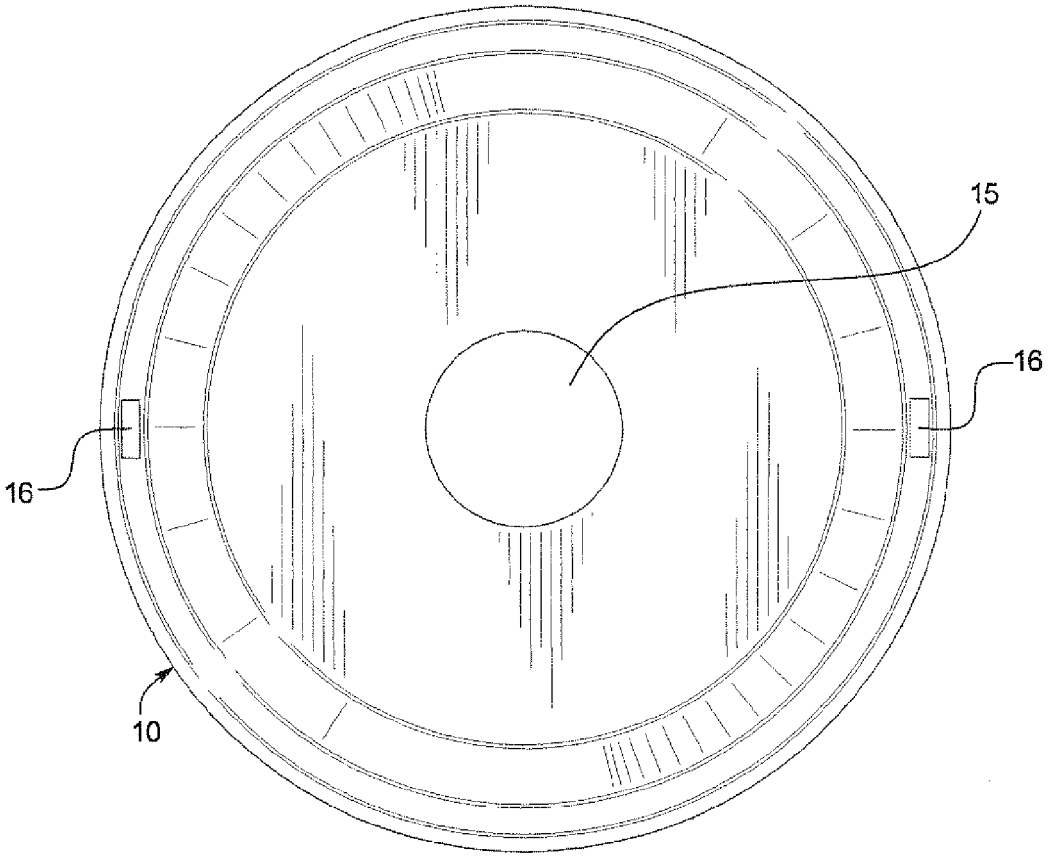
FIG. 5
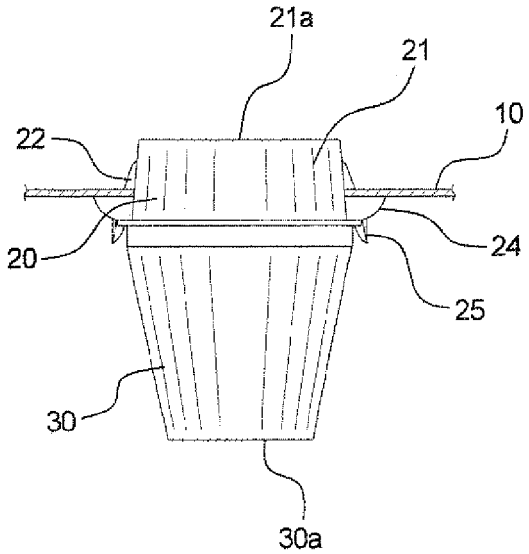

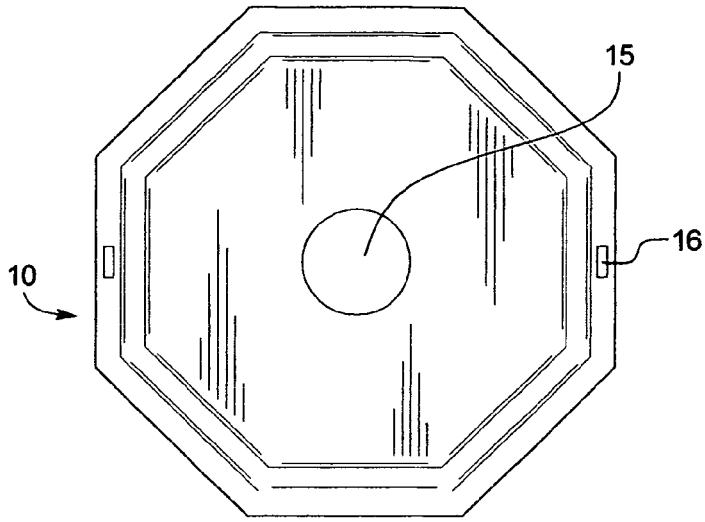
FIG. 6
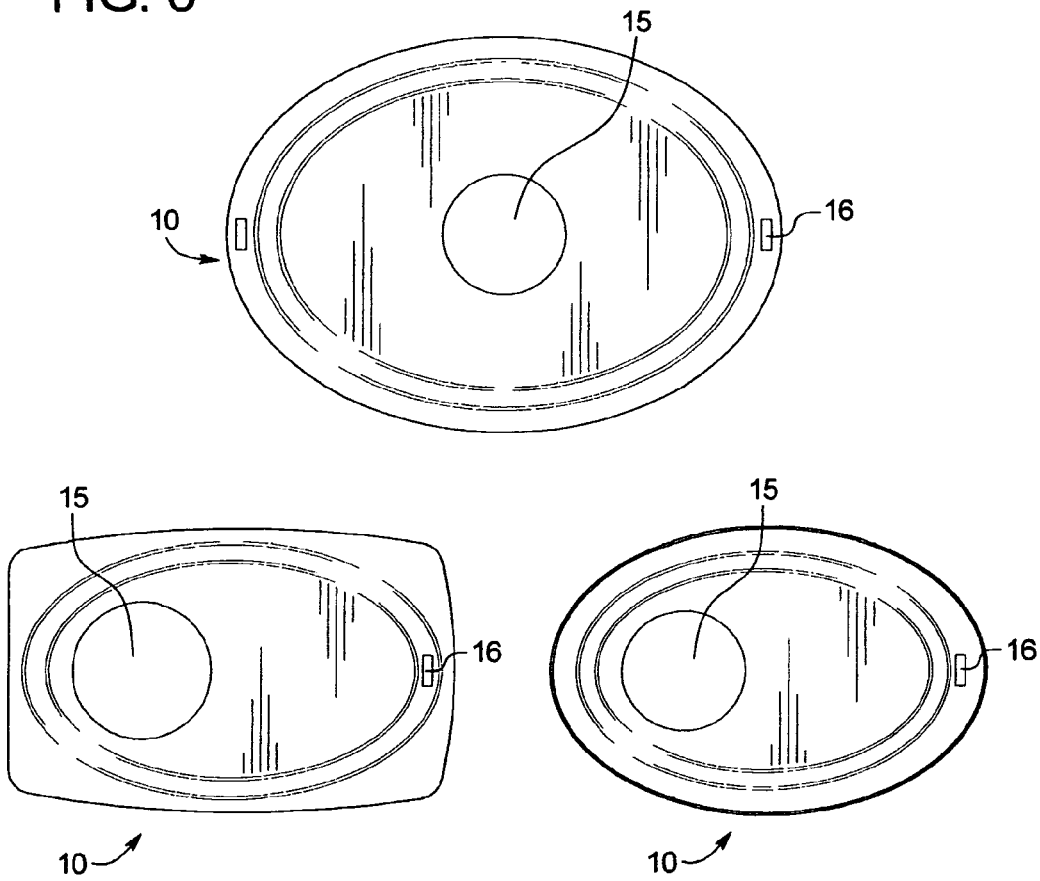

PARTY PLATE

This application is a continuation-in-part of application Ser. No. 12/589,725, filed Oct. 28, 2009.

BACKGROUND OF THE INVENTION

The present invention relates to a plate for use at social gatherings and the like wherein such plate serves as a plate for food as well as a holder for an eating utensil, a napkin, and a beverage container, thereby enabling the user to hold all with one hand while leaving the other hand free to shake hands with others, to talk on cell phone, to use the eating utensil or napkin, or to drink the beverage.

DESCRIPTION OF THE PRIOR ART

The prior art is replete with attempts to provide food and beverage combo serving units which the user may hold with one hand while freeing up the other hand to shake hands and socialize, or handle eating utensils (forks, spoons, knives, napkins). These attempts have been plagued, however, with complex designs which may be difficult to manufacture, such units often requiring the provision of expensive molding operations to fashion same.

Still further, some of the units disclosed in the prior art often serve only to provide a support means upon which the plate and beverage container are placed.

None of the above patents and inventions, taken either singly or in combination, is seen to describe the instant invention as claimed herein.

SUMMARY OF THE INVENTION

It is, therefore, an object of the present invention to provide a plate for food and a beverage holder for drink designed to be held with one hand, leaving the user's other hand free to perform other functions and tasks.

It is another object of the present invention to provide a composite plate and beverage holder designed to also include means for holding thereupon an eating utensil and napkin.

It is still another object of the present invention to provide a composite plate and beverage holder designed in such a manner so that when in use provides a convenient and stable surface for the deposition of an abundance of food, such stability being further enhanced by the weight of the beverage when placed in the beverage holder.

It is yet a further object of the present invention to provide a composite party plate and beverage holder of simplistic design and inexpensive manufacture.

These and other objects of the present invention will be best understood upon a reading of the following detailed description taken in connection with the accompanying drawings which form part of the specification, with the understanding, however, that the invention is not confined to a strict conformity with the drawings but may be changed or modified so long as such changes or modifications constitute no material departure from the salient features of the invention as expressed in the appended claims.

BRIEF DESCRIPTION OF THE DRAWINGS

FIG. 5 includes a top perspective view of the plate component of the present invention, in addition to a side cross-sectional view of the plate, the plate aperture coupler, and the cup holder component which form part of the composite exemplary of the present invention.

FIG. 6 depicts top perspective views of different configurations of the plate component forming part of the composite of the present invention showing respectively center and off-center placements of the plate aperture upon the various plate configurations.

DESCRIPTION OF THE PREFERRED EMBODIMENT

Figure 1:
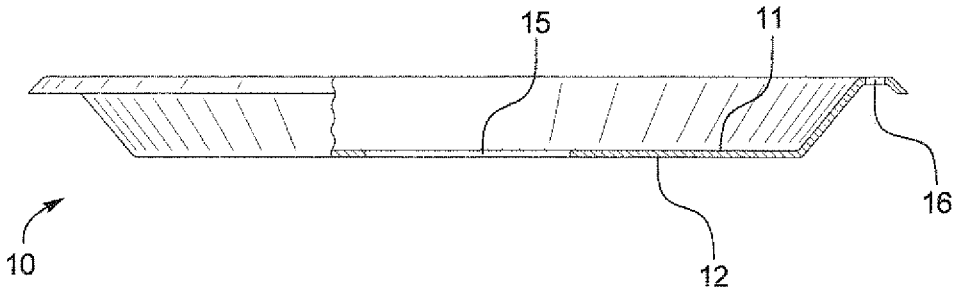
FIG. 1 is a side cross-sectional view of the of the plate component forming part of the composite exemplary of the present invention.

Referring now to the drawing figures, FIG. 1 is a side cross-sectional view of the plate component 10 forming part of the composite which is exemplary of the present invention. As shown, the plate component 10 includes an upper surface 11, upon which food is served, and a lower surface 12. Plate component 10, which may be made of a disposable paper, plastic or foamed plastic such as STYROFOAM, and which may be of varying shapes such as circular, hexagonal, oval, rectangular and the like, includes an aperture 15, preferably circular in configuration, depending through its upper surface 11 and lower surface 12, such aperture 15 being located substantially near the center of the plate component 10, as can be more clearly seen in FIG. 2.

While the present embodiment teaches an arrangement wherein aperture 15 is located in the center of plate component 10, placement of aperture 15 off-center on plate component 10 is also contemplated as forming part of the present invention.

Figure 2:
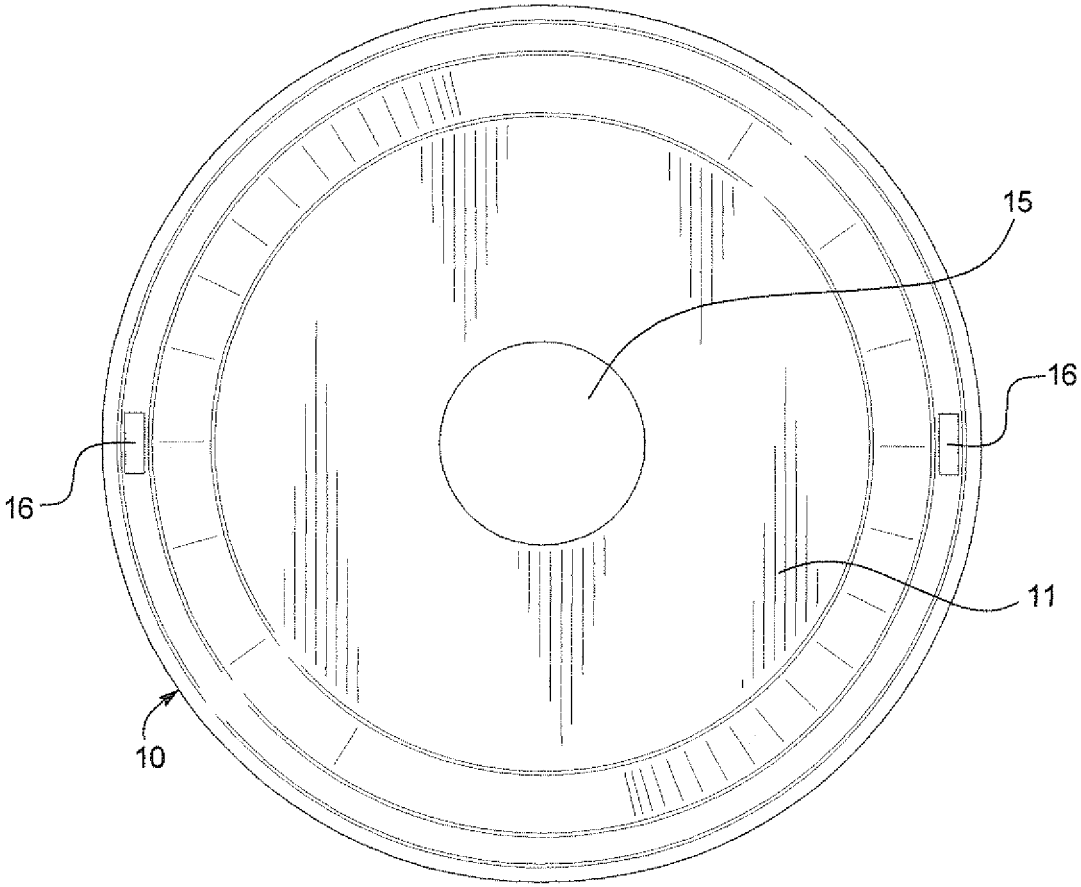
FIG. 2 is a top view of the plate component forming part of the composite exemplary of the present invention showing the centrally-located aperture thereof.

Also depicted in FIG. 2 is one of what may be a plurality of elongated slots 16 disposed along the outer circumferential ridge of plate component 10 for the placement therein of eating utensils and/or napkins.

Figure 3:
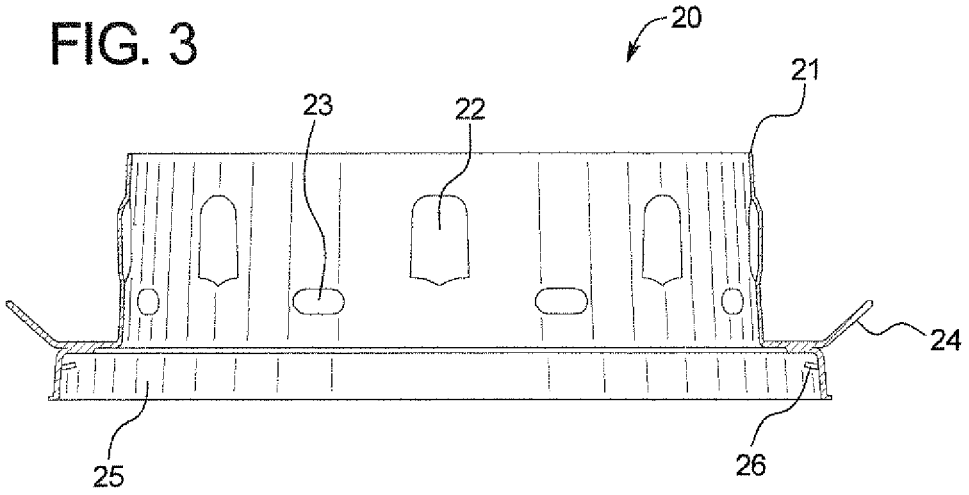
FIG. 3 is a side cross-sectional view of the plate aperture coupler component which forms part of the composite exemplary of the present invention.
Figure 4:
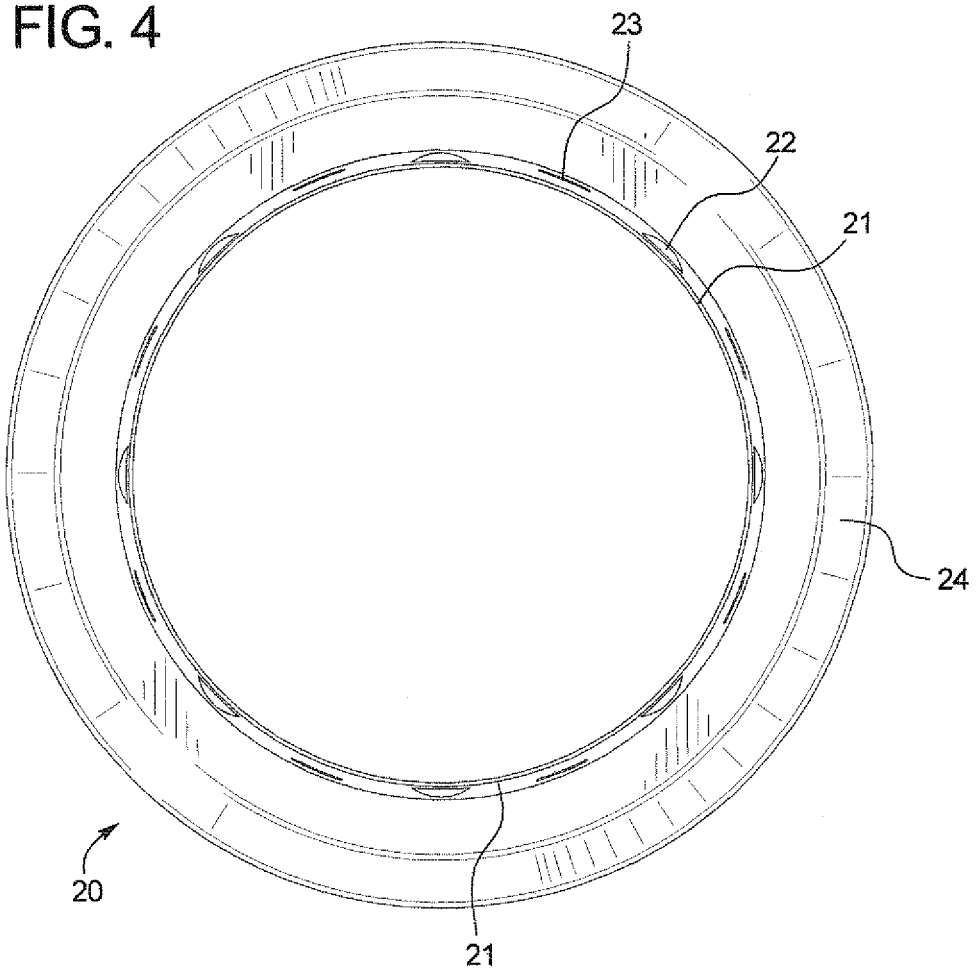
FIG. 4 is a top perspective view of the plate aperture coupler component which forms part of the composite exemplary of the present invention.

FIGS. 3 and 4 depict, respectively, a side cross-sectional view and a top perspective view of the plate aperture coupler component 20 of the present invention.

As can be seen in FIG. 3, plate aperture coupler component 20 is of a single-piece molded construction, and includes a plurality of convex, essentially rectangular plate retainer means 22 spatially-disposed upon the outer peripheral surface of the upwardly-extending beverage container means 21. Plate component 15 is preferably designed to slide down over plate retainer means 22 with plate component 10 being locked into place as it is wedged between the bottoms of plate retainer means 22 at the upper surface 11 and plate support means 24 at its lower surface 12, as will be more clearly illustrated hereinbelow.

Centrally-located between, and disposed near the bottom of the plate retainer means 22 are a plurality of horizontally-disposed, oblong-shaped perforations 23 extending longitudinally around the periphery of upwardly-extending beverage retainer means 21. Perforations 23 are so located in order to facilitate the disposition of any run-off of food juices or the like from plate component upper surface 11 into the bottom of beverage container holder 30 when the composite of the present invention is in use.

Integrally-formed on the lower exterior circumference of upwardly-extending beverage container holder means 21 is plate support means 24. Plate support means 24 extends longitudinally-outwardly from the lower exterior circumference of beverage container holder means 21, and is angled-upwardly therefrom.

Appropriately attached to, and integrally-formed with, the lower surface of upwardly-angled plate support means 24, at the juncture where plate support means 24 angles upwardly, is a downwardly-extending cup holder means 25 having a lip 26 extending horizontally around the interior surface thereof.

Plate aperture coupler component 20 may be made of any suitable material such as paper, cardboard, plastic, foamed plastic, metal, wood, stoneware, glass, carved stone or the like.

Beverage container holder component 30 is designed for attachment to plate aperture coupler component 20 by means of lip 26 of downwardly-extending cup holder means 25.

FIG. 5 is exemplary of the composite which forms the present invention. As can be seen, the party plate composite of the present invention is formed by coupling the beverage container holder component 30 onto the bottom of the plate aperture coupler means 20 followed by insertion through aperture 15 of plate component 10. Alternatively, manufacturing costs may be further decreased or minimized by the production of a coupler-beverage container holder component which combines plate aperture coupler means 20 and beverage container holder means 30 into a unitary structure. In such an embodiment the need for downwardly-extending cup holder means 25 and its integrally-formed lip 26 which extends horizontally around the interior surface thereof would be obviated or become unnecessary in the configuration of the party plate composite of the present invention.

In operation, and as shown in FIG. 5, the upper rim of beverage container holder component 30 is coupled with, and attached to, the lower interior circumferential surface of coupler component 20, and is locked into place through the provision of lip 26 thereof. The upper extremity 21*a* of the upwardly-extending beverage container means 21 is then inserted into the aperture 15 of the plate component 10 to form the party plate composite of the present invention when aperture 15 of plate component 10 passes over the plurality of plate retainer means 22 thereby causing the upper surface 11 of plate component 10 to abut against the lower surfaces of the plurality of plate retainer means 22. As illustrated, the lower surface 12 of plate component 10 rests securely upon, and abuts against, the upper surface of upwardly-angled plate support means 24, and is, thereby, securely locked into place between the lower surfaces of the plurality of plate retainer means 22 and the upper surface of upwardly-angled plate support means 24 to form the instant party plate composite. A beverage container, such as a soft drink or beer can or bottle, is then placed into the beverage container holder means 21 and extends therethrough into beverage holder component 30, the base 30*a* of which may be sat upon a flat surface such as a table top whereupon food may be appropriately deposited upon the upper surface 11 of plate component 10. The user may then pick up, and hold, the party plate composite of the present invention by grasping beverage container holder component about its outer circumferential surface.

While it is envisioned that the party plate composite will provide the requisite stability when food is appropriately placed upon the upper surface 11 of plate component 10 so as not to have the party plate composite tip over and spill the user's serving of food, it should be recognized that additional stability is provided to the party plate composite of the present invention by the weight of the beverage container placed within the beverage container holder means 30 as described hereinabove.

It is to be understood that the present invention is not to be taken as being limited to the accompanying drawings and specification. While a particular embodiment of the present invention has been illustrated and described, it is not intended to limit the invention to such disclosure, but changes and modifications may be made therein and thereto.

It is also to be understood that the phraseology and terminology herein employed are for purposes of description and not of limitation, since the scope of the present invention is denoted by the appended claims.

What is claimed is:

1. A party plate composite comprising (a) a plate component having an upper surface and a lower surface, said plate component having an aperture depending through its upper and lower surfaces, and being useful for depositing food upon the upper surface thereof, (b) a coupler component for disposition into said aperture and for attachment within said aperture of said plate component, said coupler component including (1) an upwardly-extending beverage container holder means, (2) a plate support means Integrally-formed on said upwardly-extending beverage container holder means, said plate support means and extending longitudinally-outwardly and being angled upwardly therefrom, and (3) a downwardly-extending cup holder means being defined by the lowermost exterior circumference of said beverage container holder means, said downwardly-extending cup holder means being integrally-formed within an attached beverage container holder component, and (c) a beverage container holder component appropriately attached to the lower portion of said coupler component.

2. The party plate composite of claim 1, wherein said plate is disposable.

3. The party plate composite of claim 1, wherein said plate component is made of paper, plastic or foamed plastic.

4. The party plate composite of claim 1, wherein said plate component may have a variety of shapes.

5. The party plate composite of claim 1, wherein said aperture may be located substantially near the center of the plate component.

6. The party plate composite of claim 1, wherein said aperture is located away from the center of said plate component.

7. The party plate composite of claim 1, wherein said coupler component is of unitary construction.

8. The party plate composite of claim 1, wherein said cup holder includes a retainer means for fastening to the upper lip of a cup.

9. A party plate composite comprising (a) a plate component having upper and lower surfaces, said upper surface being utilized for depositing food thereupon, said plate component having an aperture depending through its upper and lower surfaces, (b) a coupler-beverage container holder combination component for disposition into said aperture and for attachment within said aperture, said coupler-beverage container holder combination component including (1) an upwardly extending beverage container holder means, (2) a plate support means integrally-formed on the exterior circumference of said upwardly-extending beverage container holder means, said plate support means extending longitudinally-outwardly and being angled upwardly therefrom, and (3) a downwardly-extending cup holder means being defined by the lowermost exterior circumference of said beverage container holder means and the uppermost inner circumference of said downwardly-extending cup holder means, said downwardly-extending cup holder means being integrally-formed with said beverage container holder, and (c) a beverage container holder component appropriately attached to the lower portion of said circular coupler component.

10. The party plate composite of claim 9, wherein said plate is disposable.

11. The party plate composite of claim 9, wherein said plate is made of paper, plastic or foamed plastic.

12. The party plate composite of claim 9, wherein said plate component may have a variety of shapes.

13. The party plate composite of claim 9, wherein said aperture may be located substantially near the center of the plate component.

14. The party plate composite of claim 9, wherein said aperture is located away from the center of said plate component.

15. The party plate composite of claim 9, wherein said coupler-beverage container-holder combination component is of unitary construction.

* * * * *